United States Patent [19]

Shull

[11] 3,951,444

[45] Apr. 20, 1976

[54] LOCK ASSEMBLY WITH RESILIENT LATCH

[75] Inventor: Paul H. Shull, Orange, Calif.

[73] Assignee: Elixir Industries, Gardena, Calif.

[22] Filed: Dec. 19, 1974

[21] Appl. No.: 534,181

Related U.S. Application Data

[62] Division of Ser. No. 328,767, Feb. 1, 1973, Pat. No. 3,877,268.

[52] U.S. Cl. ..... 292/359; 292/204

[51] Int. Cl.[2] ..... E05C 13/00

[58] Field of Search ..... 292/359, 204, 207, 202, 292/358, 101, 103, 106; 70/146, 150

[56] References Cited

UNITED STATES PATENTS

| | | | |
|---|---|---|---|
| 649,706 | 5/1900 | Phelps | 292/359 X |
| 692,068 | 1/1902 | Patrick | 70/14 C |
| 2,644,704 | 7/1953 | Hagstrom | 292/359 X |
| 2,839,913 | 6/1958 | Friedman | 70/146 |

*Primary Examiner*—Robert L. Wolfe
*Attorney, Agent, or Firm*—Gausewitz, Carr & Rothenberg

[57] ABSTRACT

A retainer cylinder is rotatably mounted in the bore of a housing cylinder and selectively latched against rotation by means of a resilient latching assembly. The housing cylinder is formed with a longitudinally extending groove and a corresponding recess is formed in the retainer cylinder. In one arrangement, the resilient latching assembly comprises a flat spring captured in the housing cylinder groove and having an intermediate portion resiliently urged into the retainer cylinder recess. A dog slidably mounted in the recess is cammed by a key to force the spring element from the recess and allow rotation of the retainer cylinder. In a second arrangement, the same housing cylinder allows for handle operation of a retainer cylinder wherein the latching assembly comprises a cam pin resiliently mounted in the retainer cylinder recess.

8 Claims, 12 Drawing Figures

FIG. 7.
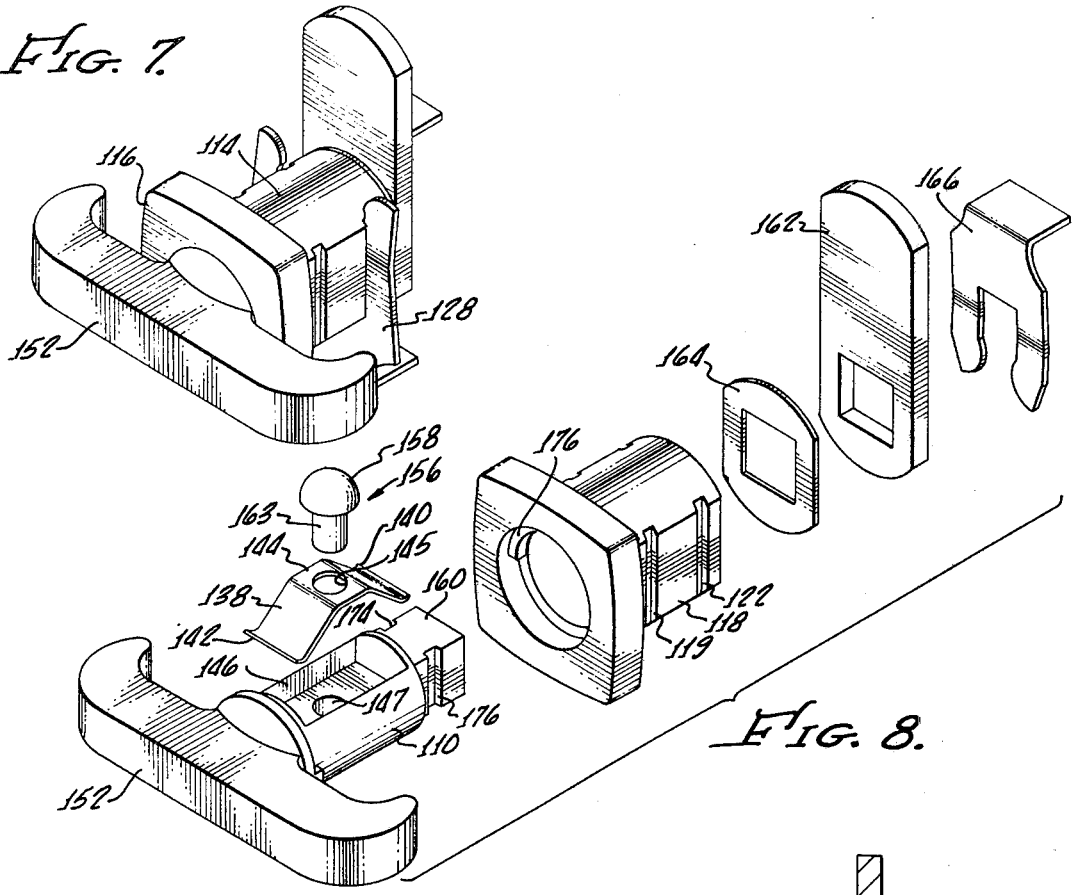
FIG. 8.
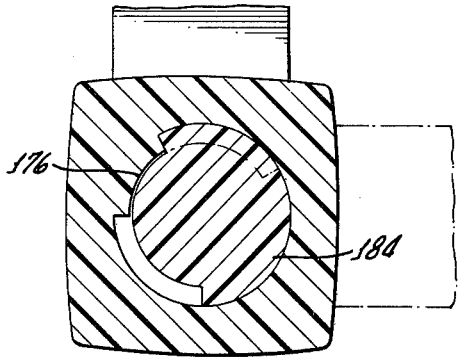
FIG. 10.
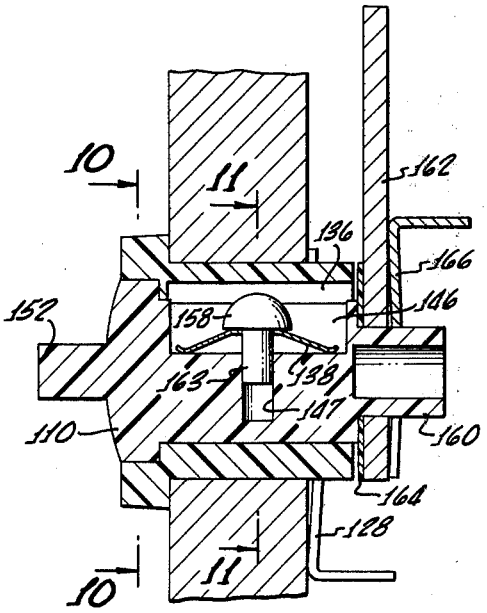
FIG. 9.
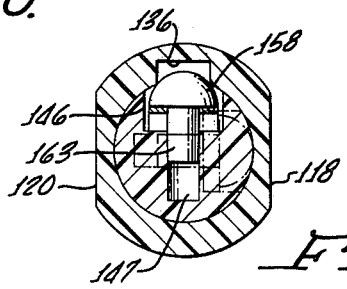
FIG. 11.

LOCK ASSEMBLY WITH RESILIENT LATCH

This is a division of application Ser. No. 328,767 filed Feb. 1, 1973 now U.S. Pat. No. 3,877,268.

BACKGROUND OF THE INVENTION

1. Field of the Invention:

The present invention relates to lock assemblies and more particularly concerns lock assemblies having internally mounted resilient latching means.

2. Description of Prior Art

Locks and latches for doors and other closures, particularly in the field of travel trailers and camping vehicles, are of several types. There is a variety of sturdy, complex and expensive key operated locks, generally employed for the large door of greater structural strength. For smaller doors and in particular for those of little strength, such as doors formed of thin aluminum or other panels, it is common to use spring or magnetic latches having no key operation and no locking cam.

The heavy, complicated and expensive key operated locks are not readily installed in the thin door panels and, moreover, are not warranted for such type of door construction. Nevertheless, it is still desirable that the thin door panel be provided with a positive locking device and preferably one that provides some measure of protection against unauthorized entry where desired. Thus, for doors of travel trailer or camper baggage compartments, there is required and desired a key-operated lock assembly that is compatible with the thin panel construction of the conventional door. Utility compartment doors, on the other hand, must be readily accessible and readily opened for safety purposes. Therefore, it is desired to provide such doors that will be positively latched when closed, but which may be readily unlatched, without a key, by turning a knob provided on the lock itself.

It is an object of the present invention to provide locking assemblies of a simple and inexpensive nature that are readily adapted to provide positive latching and protection against unwanted opening when desired, or merely positive latching, without the use of heavy, complex and expensive locking structure.

SUMMARY OF THE INVENTION

In carrying out principles of the present invention in accordance with a preferred embodiment thereof, a lock assembly is formed of a housing cylinder having a bore and a retainer rotatably mounted in the bore. A resilient latch assembly is carried internally of the lock between the housing and retainer cylinders to selectively prevent relative rotation of the two cylinders. In a first embodiment a spring carried by a groove in the housing has a portion extending into a mating recess in the retainer cylinder but may be cammed to unlocked position by means of a key-operated dog operable in the retainer cylinder.

In a second embodiment, the same internally grooved housing is employed together with a rotatable retainer cylinder carrying a spring pressed cam pin that latches into the housing groove. In this embodiment, a handle or knob of the retainer cylinder is employed for operation of the lock or catch assembly without a separate key.

BRIEF DESCRIPTION OF THE DRAWINGS

FIG. 7 is a pictorial view of a second embodiment of the present invention;

FIG. 8 is an exploded pictorial view of the parts of the lock assembly of FIG. 7 omitting one retainer clip;

FIG. 9 is a sectional view of the lock assembly of FIG. 7; and

FIGS. 10 and 11 are cross-sectional views of the lock assembly of FIG. 9.

DETAILED DESCRIPTION

Figures 1, 2, 3, 4, 5, 6, 6A:
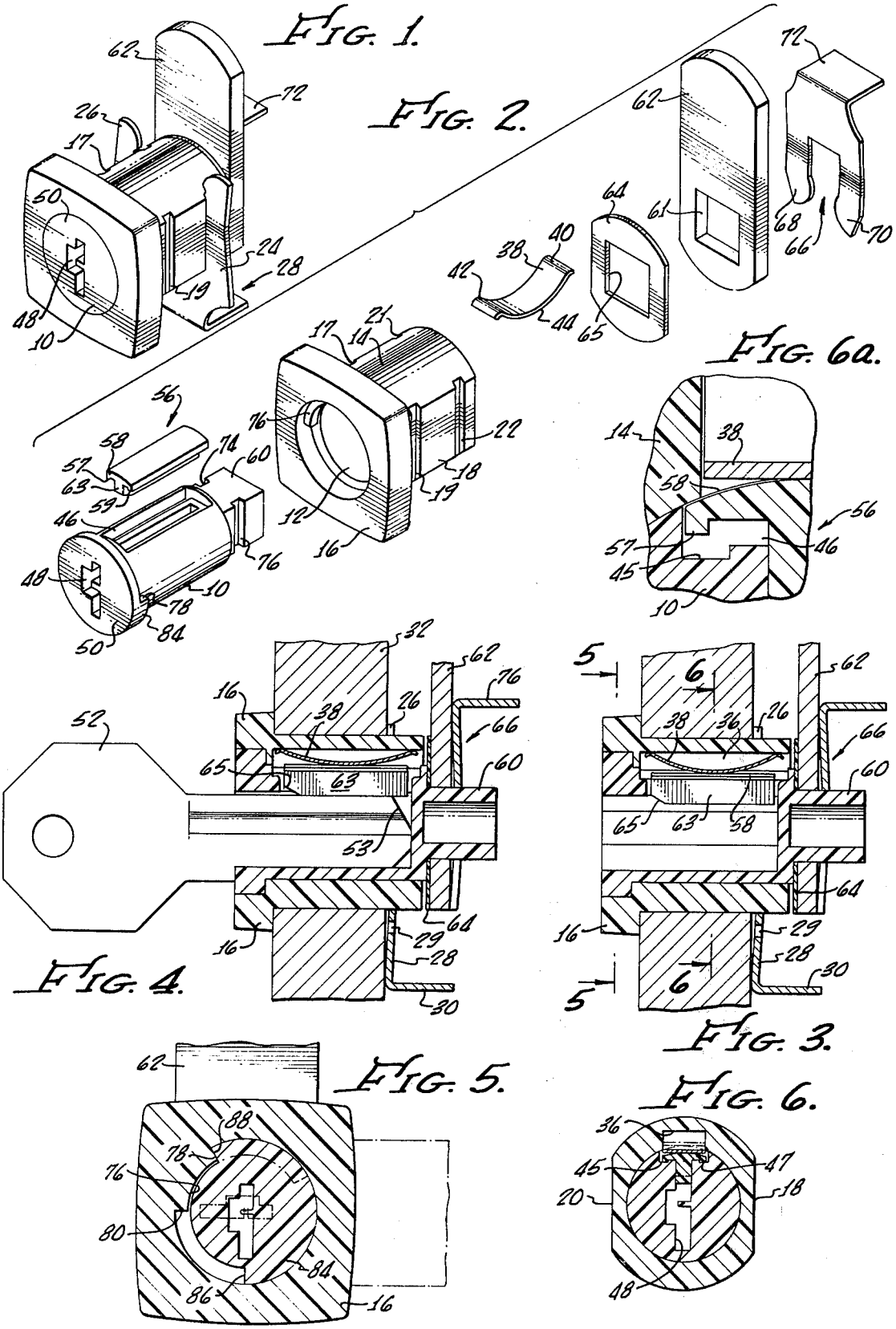
FIG. 1 is a pictorial view of a lock assembly employing principles of a first embodiment of the present invention.
FIG. 2 is an exploded pictorial view of the components of the lock assembly of FIG. 1, omitting one retainer clip.
FIG. 3 is a sectional view of the lock assembly of FIG. 1 showing the parts in unlatched position.
FIG. 4 is a sectional view of the lock assembly of FIG. 1 showing the parts in unlatched position.
FIGS. 5 and 6 are cross-sectional views of the assembly shown in FIG. 3.
FIG. 6*a* is a greatly enlarged fragmentary view of part of the assembly shown in FIG. 6.

Referring to FIGS. 1 through 4, a retainer cylinder 10 is rotatably mounted within the bore 12 of a housing cylinder 14. Housing cylinder 14 is formed with an enlarged integral facing flange 16 and has a pair of oppositely disposed flat surfaces 18, 20 (FIG. 6) in which are formed pairs of locking grooves 17, 19 and 21, 22. Grooves 21, 22 respectively receive the oppositely disposed legs 24, 26 of a housing retainer clip 28 (not shown in FIG. 2). Housing retainer clip 28 is formed with an angulated flange 30 (FIGS. 3 and 4) that facilitates insertion of the retainer clip legs in the grooves 21, 22 without the use of tools. The legs of the housing retainer clip 28 are bent to a small degree as shown in FIGS. 1, 3 and 4 so as to resiliently press against a door panel 32 to which the locking assembly is mounted. The locking assembly is secured to the door panel by clamping the latter between the facing flange 16 of the housing cylinder and the housing retainer clip 28. Legs 24, 26 of the retainer clip are forced into the grooves in the housing cylinder flats 18, 20 after the body of the housing cylinder is inserted through an appropriate aperture of the door panel 32.

Housing cylinder 14 is formed with a longitudinally extending groove 36 in which is mounted an elongated spring element 38. Spring 38 has end portions 40, 42 that are captured within and bear upon the bottom (outermost portion) of the groove 36 of housing cylinder 14. An intermediate section 44 of the spring 38, in unstressed position, projects from the groove 36 of the housing cylinder 14 into a recess 46 that extends for a major portion of the length of retainer cylinder 10. Recess 46 has the bottom or radially inner side thereof in communication with a keyway 48 that runs from a front facing surface 50 of the retainer cylinder through a major portion of its body. Keyway 48 is shaped with a suitable irregular cross-section to uniquely receive the body of a key 52 which operates in a fashion to be described more particularly hereinafter.

Slidably mounted for radial motion in the recess 46 of retainer cylinder 10 is a dog 56 formed with a substantially T-shaped cross-section. Dog 56 has an outwardly convex transverse arm 58 and a radially inwardly depending leg 63 that extends into an upper portion of the keyway.

To provide a more compact and dimensionally stable assembly, the opposite longitudinally extending sides of the bottom portion of recess 46 are formed with longitudinally extending grooves 45, 47 to receive depending flanges 57, 59 of the transverse arm 58 of dog 56. An enlarged detail of part of this configuration is shown in FIG. 6a. With this arrangement, greater rigidity of the dog is provided and the dog is firmly positioned within the recess 46 of the retainer cylinder when the apparatus is in locked position. Further, the uppermost surface of the cross arm 58, when the key is inserted, extends to the outer cylindrical periphery of the retainer cylinder and thus, beyond the outermost edge of recess 46. Nevertheless, the depending flanges 57, 59, in this unlocked position, will still extend into the recess 46 (see FIG. 6*a*) so as to prevent any inadvertant circumferentially directed motion of the dog 56 relative to the retainer cylinder 10 as the cylinder is rotated with respect to the housing cylinder. In other words, the flanges 57, 59 keep the dog 56 from being displaced laterally of recess 46 to a position from which it would not be readily returned to the locking position.

Retainer cylinder 10 is formed with a projecting necked-down stub shaft 60, preferably of non-circular or rectangular cross-section as indicated, for reception of a locking tongue or cam 62 having a rectangular aperture 61 that snugly receives the rectangular cross-section stub shaft 60. A washer 64 of low-friction material is interposed between cam 62 and the larger diameter body portion of retainer cylinder 10 to provide a smooth sliding surface against the end of the housing cylinder 14. Washer 64 has a rectangular aperture 65 that mates with the rectangular cross-section of the necked-down stub shaft 60. Cam 62 is retained upon the stub shaft 60 by means of a second retainer clip 66 having legs 68, 70 and an angulated flange 72. Retainer clip 66 is substantially identical to retainer clip 28 except that the former is smaller than the latter so that legs 66, 70 will be clamped and locked in oppositely disposed grooves 74, 76 of the necked-down stub shaft 60 of the retainer cylinder 10.

The door 32 of which a section is shown in FIGS. 3, 4 and 5 has a relatively great thickness such as may be found in a panel door that is insulated or otherwise built up. For use with a door of such thickness retainer clip 28 is inserted in grooves 21, 22 of flats 20, 18. For use with a sheet metal panel door, such as a door formed of aluminum or other metallic paneling having a thickness of 0.024 inches, for example, the retainer 28 is inserted in the grooves 17, 19 which are positioned closely adjacent facing flange 16 of the housing cylinder 14. Thus, the locking assembly may be used alternatively with a thick door as shown in FIGS. 3 and 4 or with a thin sheet metal door when the retainer clip 28 is positioned in grooves 17, 19 that are located closer to the facing flange 16.

Relative rotation of the retainer cylinder within the bore of the housing cylinder is limited by interaction of cooperating abutment means formed on the two relatively rotatable parts. These abutment means comprise a stop 76 having abutment shoulders 78, 80 formed on an inner portion of the housing cylinder 14 within the facing flange 16. The stop 76 of the housing cylinder cooperates with a mating stop 84 formed on the retainer cylinder and having shoulders 86, 88 (FIG. 5).

Although the lock assembly shown in FIGS. 1 through 6 obviously may be made in many different sizes, it is readily fabricated in a small size by molding. For example, housing cylinder 14 may have a total length of about 0.9 inches and a maximum transverse dimension of 0.9 inches. The outer diameter of retainer cylinder 10 and the diameter of the bore of the housing cylinder are each 0.5 inches with sufficient tolerance to provide a snug but rotatable fit. The overall length of the locking assembly, except for outwardly projecting flange 72 of the second retainer clip 66, is approximately 1.1 inches. Preferably all parts are made of a hard molded plastic excepting only the cam 62, spring 38, retainer clips 28, 66 and key 52, which are made of suitable metal.

In mounting of the locking assembly to the door indicated at 32 in FIGS. 3 and 4, the assembly of the housing cylinder, retainer cylinder, dog and spring is inserted through a suitable aperture in the door and housing retainer clip is then mounted to the mating grooves of the flat sides of the housing cylinder to firmly secure the housing to the door. Suitable retainer clip fasteners, such as nails, screws or rivets (not shown) are inserted through one or more holes 29 in the retainer clip to fix the latter, and thus the entire assembly to the door. Washer 64, cam 62 and retainer clip 66 are then mounted upon stub shaft 60 and assembly is complete.

In the latched position illustrated in FIG. 3, the key 52 is withdrawin from the keyway 48 and the transverse arm 58 of the dog 56 is pressed radially inwardly toward the bottom of recess 46 by the intermediate portion 44 of spring 38. In this position, the intermediate portion 44 of spring 38 enters the recess 46. The spring has its ends 40, 42 normally captured within the groove 36. In the latched position illustrated in FIG. 3, the intermediate section 44 of the spring is also captured within the upper portion of the recess 46 of the retainer cylinder. Accordingly, relative rotation of the retainer cylinder and the housing cylinder is prevented by the spring. Since cam 62 is mounted to the retainer cylinder stub shaft 60 against rotation relative to the shaft 60, this cam is likewise locked against rotation relative to the housing cylinder 14.

To unlock the locking assembly, key 52 is inserted in keyway 48 so that a beveled surface 53 at the upper front edge thereof will cooperate with a cam surface 65 formed on the front end of the depending leg of the T-shaped dog 56 to force the dog radially outwardly against the urging of spring 38. The parts are so dimensioned that when the key is fully inserted as shown in FIG. 4, the radially outermost surface of the crossarm 58 of dog 56 lies substantially upon or slightly above or without the outer cylindrical surface of the retainer cylinder 10 (see FIG. 6*a*). Thus, the intermediate section 44 of spring 38 is urged radially outwardly so as to completely clear the recess 46 and allow relative rotation of the retainer cylinder within the housing cylinder bore. The retainer recess 46 and the dog cross arm are both wider than the groove 36 of the housing cylinder. This relation performs a twofold function. It prevents the spring 38 from being erroneously assembled in the recess (since the spring is only as wide as groove 36). Further, it limits the radially outward displacement of the dog 56 (and prevents the latter from entering groove 36) by abutment of the outer edges of the dog cross arm with the housing cylinder bore at edges of groove 36.

Although the parts may be made with a limited degree of motion of 90°, 180° or some other amount, it is preferred to limit the relative rotation to 90° as best shown in FIG. 5. As illustrated in this Figure, the keyway 48 is substantially vertical when the parts are in locked position. Further motion of the retainer cylinder in a counter-clockwise direction (as viewed in FIG. 5) relative to the housing cylinder is limited by engagement of stop shoulders 78, 88. With the key inserted as shown in FIG. 4, the retainer cylinder may be rotated clockwise relative to the housing cylinder through 90° to the dotted line position shown in FIG. 5 wherein relative motion is limited by engagement of stop shoulders 80, 86. In this position, the keyway is substantially horizontal so that a visual indication is available of the locked or unlocked condition of the assembly without the ambiguity that would exist if 180° of motion were possible.

The above-described locking assembly illustrated in FIGS. 1 through 6 is useful in a variety of applications and is particularly adapted for baggage compartments and the like, wherein a measure of security against unauthorized opening is desired. Unlocking of the assembly of FIGS. 1 through 6 requires the insertion of a key that will mate with the cross-sectional configuration of keyway 48 and accordingly, cannot be readily achieved without the key. For some situations such as for storage compartments for utilities, it is often desirable to provide a positive latch for the door that may be readily unlatched and opened without the use of a special key or tool. Such a requirement is of particular use in connection with compartments for storage of volatile materials and fuels. For use in such a situation, the lock assembly of FIGS. 1 through 6 is modified to provide a catch assembly illustrated in FIGS. 7 through 11. In the embodiment of FIGS. 7 through 11, the housing cylinder 114 is identical to the housing cylinder 14 of the embodiment described above and may be used interchangably therewith. Housing 114 includes a facing flange 116 having an abutment 176, a pair of oppositely disposed flat surfaces 118, 120, a longitudinally extending groove 136 in its bore and pairs of grooves indicated at 119, 122 in the respective flats 118, 120, all being identical to the corresponding elements of FIGS. 1 through 6. Also included for the use of the housing cylinder 114 is a housing retainer clip 128 identical to clip 28 of the first embodiment. This clip is not shown in the exploded view of FIG. 8.

In the embodiment of FIGS. 7 through 11, the retainer cylinder 110 is likewise formed with a retainer cylinder recess 146 which in locked position mates with (but is wider than) the longitudinally extending groove 136 of the housing cylinder. Retainer cylinder recess 146 extends for substantially the full length of the main body portion of the retainer cylinder 110. The latter, like the corresponding cylinder in the prior embodiment is formed with an integral projected necked-down stub shaft 160 of irregular crosssection such as the rectangular cross section illustrated, having retainer clip receiving grooves 174, 176 receiving the legs of a second retainer clip 166. Mounted on the projecting stub shaft 160 are a friction minimizing washer 164 and a locking cam 162, all constructed and arranged just as are the corresponding components of the embodiment of FIGS. 1 through 6. Although the stub shaft 160 may be made hollow in each of the embodiments, it also may be made solid if deemed necessary or desirable for either or both the described arrangements.

In the arrangement of FIG. 7, the latching means that is mounted to the retainer cylinder cooperates with the groove 136 in the housing cylinder and is formed of a spring 138 having end portions 140, 142 and an intermediate portion 144. Intermediate portion 144 is apertured as at 145 to receive the shank 163 of a cam pin 156 having a substantially hemispherical head 158. Recess 146 is formed with a radially extending bore 147 that slidably receives the depending shank or leg 163 of cam pin 156.

Integrally formed on one end of the retainer cylinder 110 is a knob or handle 152.

The embodiment of FIG. 7 through 11 is mounted to a door in the manner described in connection with the embodiment of FIGS. 1 through 6. It may be noted at this point that where the assembly is to be mounted to a thin panel door such as a door of sheet metal and the like, the entire locking assembly excepting only the housing retainer clip 128 may be fully assembled and the apparatus maneuvered to insert first the free end of the cam and then the corresponding part of the housing through the aperture in the thin door panel, whereupon retainer clip 28 may be affixed to the housing to secure the entire assembly in position.

In the locked position illustrated in FIG. 9 and in full lines in FIG. 11, the end 158 of the cam pin is urged radially outwardly of recess 146 by the action of the spring 138 to thereby protrude and extend into the groove 136 formed in the housing cylinder 114. Thus, the cam pin, which is at all times captured within the recess 146 and its depending bore 147, is also captured (in locked position) in the groove 136 of the housing cylinder. Forcible rotation of the handle 152 in a clockwise direction relative to the housing cylinder (as viewed in FIG. 11) causes the rounded head 158 of the cam pin to be cammed out of the groove 136 to thereby be moved radially inwardly with its shank 163 sliding inwardly of the bore 147, whereby the parts may assume the position illustrated in dotted lines in FIG. 11. In this dotted-line position, the apparatus is unlatched and the longitudinal extent of handle 152 will be in a vertical position (with the orientation shown in the drawings). This once again provides a visual indication of the latched or unlatched condition of the assembly. Just as in the embodiment of FIGS. 1 through 6, cooperating stop shoulders 176, 184 on the housing cylinder and retainer cylinder respectively, limit the relative rotation of the cylinders through 90° to and between the positions illustrated in FIG. 11.

To again lock the apparatus of FIGS. 7 through 11, the handle 152 is rotated in a counter-clockwise direction as viewed from the front of the assembly, through the illustrated 90° angle to a position wherein the urging of spring 138 will once again move the head 158 of the cam pin to project from the recess 146 and to be partly captured within the groove 136 whereby the parts are once again in the latched position.

It will be seen that there have been described simple, reliable, effective and inexpensive arrangements for locking assemblies which can be operated either with or without a key in different embodiments but which nevertheless, can employ the identical housing cylinder in either arrangement.

The foregoing detailed description is to be clearly understood as given by way of illustration and example only, the spirit and scope of this invention being limited solely by the appended claims.

What is claimed is:

1. A catch assembly comprising a housing cylinder having a bore and a longitudinally extending radially inwardly facing groove formed therein, a retainer cylinder rotatably mounted in said bore and having a radially outwardly facing recess formed therein, a dog mounted in said retainer cylinder having a cam head positioned in camming engagement with said groove, a resilient spring member captured in said recess and resiliently deformed between said retainer cylinder and said cam head, and means for driving said cam head from its engagement with said groove, said last-mentioned means comprising an operator member for rotating said retainer cylinder and dog relative to said housing cylinder so as to cause said housing cylinder groove to force said dog from said groove against the urging of said spring member and allow rotation of said retainer cylinder relative to the housing cylinder.

2. The lock assembly of claim 1 wherein said retainer cylinder includes a radially extending bore in communication with said recess and wherein said dog includes a radially extending leg slidably mounted within said bore.

3. A catch assembly comprising a housing cylinder having a bore and a longitudinally extending radially inwardly facing groove formed therein, a retainer cylinder rotatably mounted in said bore and having a radially outwardly facing recess formed therein and a radially extending bore in communication with said recess, a cam pin mounted in said retainer cylinder having a cam head positioned in said groove, said pin having a radially extending leg slidably mounted within said bore, a resilient spring member captured in said recess and resiliently deformed between said retainer cylinder and said cam head, and an operating member for rotating said retainer cylinder relative to said housing cylinder so as to cause said cam head to be forced from said groove against the urging of said spring member and allow rotation of said retainer cylinder relative to the housing cylinder, said resilient spring member comprising a flat elongated spring element having first and second end portions displaced from an intermediate section thereof, said first and second end portions being captured within said recess, said intermediate section having an aperture receiving said cam pin leg and urging said cam head toward said groove, and wherein said means for rotating said retainer cylinder comprises a handle fixedly secured thereto.

4. A catch assembly comprising a housing cylinder having a bore and a radially inwardly facing recess formed therein, a retainer cylinder mounted for rotation in said bore and formed with a radially outwardly facing recess, a resilient latch assembly having a first portion secured to one of said cylinders and a second portion detachably secured to the other of said cylinders to thereby restrain said retainer cylinder against rotation within the bore of said housing cylinder, said resilient latch assembly comprising an elongated flat spring element having first and second end sections captured within one of said recesses and having an intermediate section offset from said end sections, and a cam detachably captured within the other of said recesses and interposed between said intermediate section of said spring element and said other recess, and means for relatively rotating said cylinders to rotate said cam and spring relative to said other recess.

5. The assembly of claim 4 wherein said spring element has an aperture therein and wherein said cam comprises a dog having a projecting leg extending through said aperture and a convex head extending partly into said other recess.

6. The assembly of claim 5 wherein said one recess includes a radially extending bore formed in the bottom thereof, said leg being slidably received in said radially extending bore.

7. A latch assembly comprising a housing cylinder having a bore, an inwardly facing recess formed in said bore, a retainer cylinder rotatably mounted within said bore and having a radially outwardly facing recess formed therein, a dog mounted within one of said recesses for radial movement relative to said cylinders, said dog comprising a convex headed cam pin having a depending leg slidably received in said one recess and having the convex head thereof extending partly into the other of said recesses, a longitudinally extending spring resiliently compressed between the convex head of said dog and said one recess and having an aperture slidably receiving said depending leg, and means for effecting relative rotation of said cylinders.

8. A catch assembly comprising a housing cylinder having a bore and a radially inwardly facing groove therein, a retainer cylinder mounted for rotation in said bore and having an elongated radially outwardly facing recess therein, an elongated spring element having first and second end sections positioned in said recess and having an intermediate section offset from said end sections, a dog mounted within said recess of said retainer cylinder and having an outwardly convex head and an inwardly projecting leg, said convex head having a portion thereof captured within the groove of said housing cylinder, said intermediate section of said resilient spring element having an aperture receiving the leg of said dog, and means for forcibly rotating said retainer cylinder relative to the housing cylinder to cause the convex head of said dog to be cammed radially inwardly against the intermediate section of said spring element to release the engagement of said convex head and the groove of said housing cylinder.

* * * * *